United States Patent [19]

Brienza

[11] 4,270,473

[45] Jun. 2, 1981

[54] STITCH PATTERN VISUALIZATION

[75] Inventor: Michael J. Brienza, Ridgewood, N.J.

[73] Assignee: The Singer Company, Stamford, Conn.

[21] Appl. No.: 150,255

[22] Filed: May 15, 1980

[51] Int. Cl.[3] ..... D05B 3/02

[52] U.S. Cl. ..... 112/158 E

[58] Field of Search ..... 112/158 E, 121.11, 121.12

[56] References Cited

U.S. PATENT DOCUMENTS

| | | | |
|---|---|---|---|
| 4,055,129 | 10/1977 | Hunts et al. | 112/158 E |
| 4,149,476 | 4/1979 | Wurst et al. | 112/158 E |
| 4,154,178 | 5/1979 | Brown et al. | 112/158 E |
| 4,185,571 | 1/1980 | Minalga | 112/158 E X |

*Primary Examiner*—Peter P. Nerbun

*Attorney, Agent, or Firm*—James M. Trygg; Robert E. Smith; Edward L. Bell

[57] ABSTRACT

A sewing machine wherein there is provided a visual representation of the actual amplitude of vibration of certain stitch forming instrumentalities so that the stitch pattern to be sewn or a portion thereof may be visually superimposed upon the work piece by the operator so that the work piece may be properly positioned and the desired amplitude of the pattern selected.

11 Claims, 4 Drawing Figures

Fig. 1
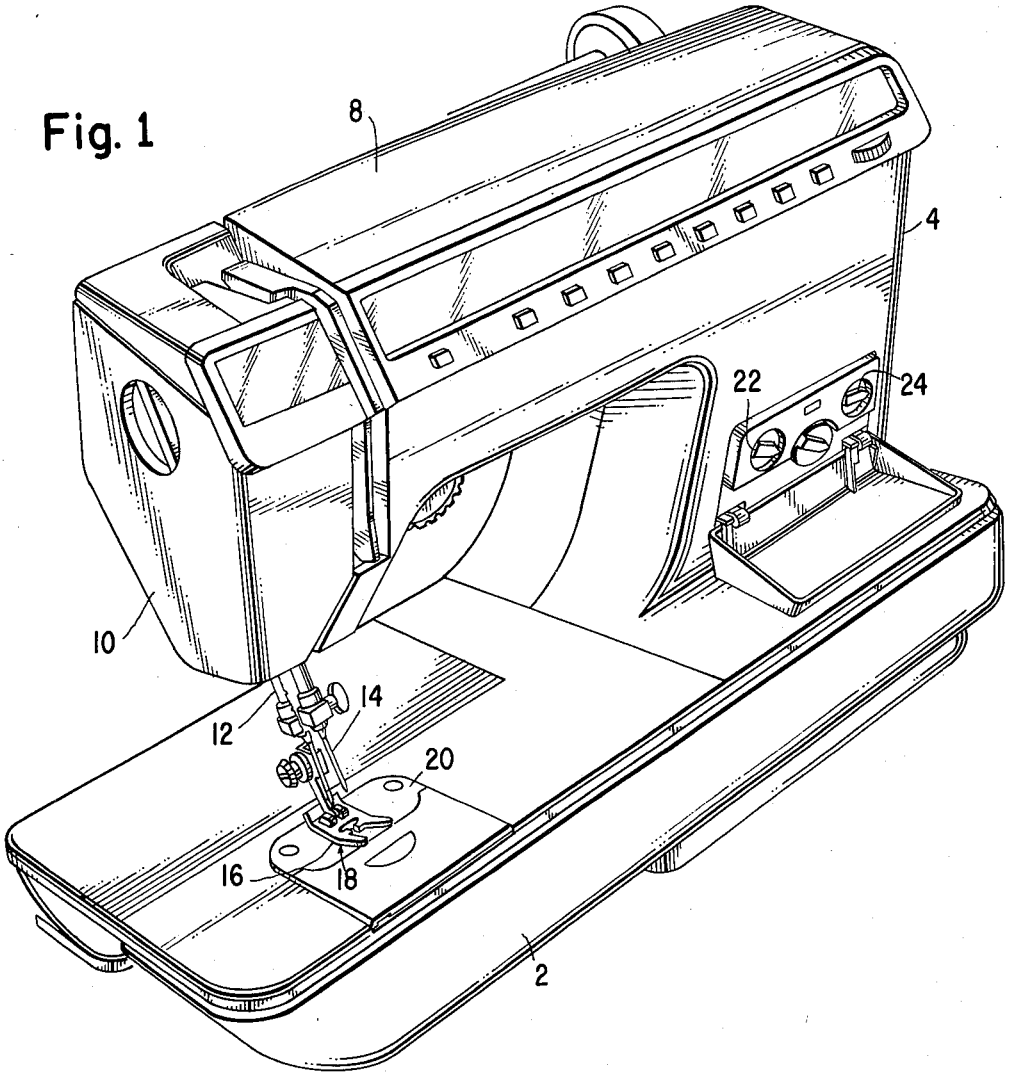
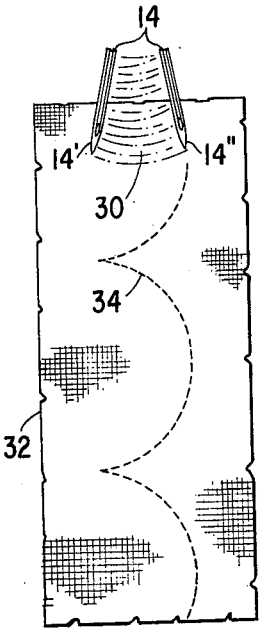
Fig. 2
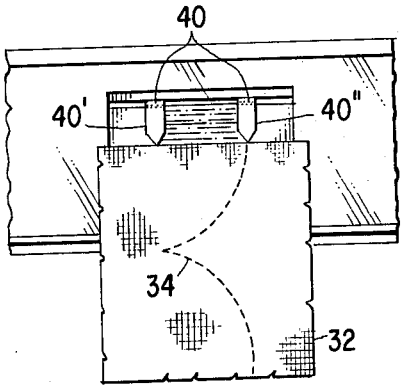
Fig. 3

STITCH PATTERN VISUALIZATION

DESCRIPTION

BACKGROUND OF THE INVENTION

In the use of a household sewing machine for sewing ornamental stitch patterns, the work piece must be positioned accurately with respect to the needle prior to beginning the sewing operation. Further, the regulators associated with the pattern forming mechanism of the sewing machine must be in a known position of adjustment with respect to the ornamental pattern to be sewn, and the width of zigzag stitching of the pattern must be known, for instance, in order to continue sewing a previously stitched pattern, or to match a previously stitched buttonhole, or the like.

Solutions to the problem of providing visualization of the characteristics of the actual stitching to be produced by a sewing machine prior to the actual stitching are unprecedented in the prior art.

In prior known sewing machines, only arbitrary indicia associated with operator influenced regulators have been provided to inform the operator what stitching characteristics might be expected, so that unless the operator used trial and error methods such as first sewing on a scrap of fabric there would be uncertainty of the precise stitching result which would be obtained from any particular setting of the regulators. Frequently, it is not possible nor convenient to test the settings on a scrap fabric as where setting changes must be made while a stitched article remains in place under the presser foot of a sewing machine. Other trial and error methods such as manually turning the handwheel to observe needle penetration of the work piece are not only ineffective to indicate aesthetic effect of pattern size differences, but may result in unnecessary needle penetration of a work piece outside the area encompassed by the pattern to be sewn.

SUMMARY OF THE INVENTION

The present invention overcomes these difficulties of the prior art by providing a visual representation of the actual amplitude of the pattern to be sewn by the stitch forming instrumentalities such that the pattern or a portion thereof may be visually superimposed upon the work piece by the operator, the work piece properly positioned, and the desired amplitude of the pattern set.

It is another object of this invention to obviate the possibility of needle penetration of the work piece while the pattern is visually superimposed upon the work piece.

Other objects and advantages of the invention will become apparent through reference to the accompanying drawings and descriptive matter which illustrate a preferred embodiment of this invention.

According to the present invention, there is provided a sewing machine having stitch forming instrumentalities, at least one of which partakes of vibratory motion for forming lockstitches wherein the amplitude of the vibratory motion influences the appearance of the lockstitches. An operator influenced control means is provided for regulating the amplitude of the vibratory motion. Means is provided for effecting the vibratory motion so that the stitch forming instrumentalities will provide a visual representation of the actual amplitude of the vibratory motion while at least one other stitch forming instrumentality is inoperative.

BRIEF DESCRIPTION OF THE DRAWINGS

In order that the invention be more fully understood, it will now be described by way of example with reference to the accompanying drawings in which:

FIG. 1 is a perspective view of a household sewing machine having the present invention incorporated therein;

FIG. 2 is a schematic diagram showing a sewing machine needle having vibratory motion in relation to a work piece;

FIG. 3 is a schematic diagram showing a representation of a sewing machine needle having vibratory motion in relation to a work piece;

DESCRIPTION OF THE PREFERRED EMBODIMENT

Figure 4:
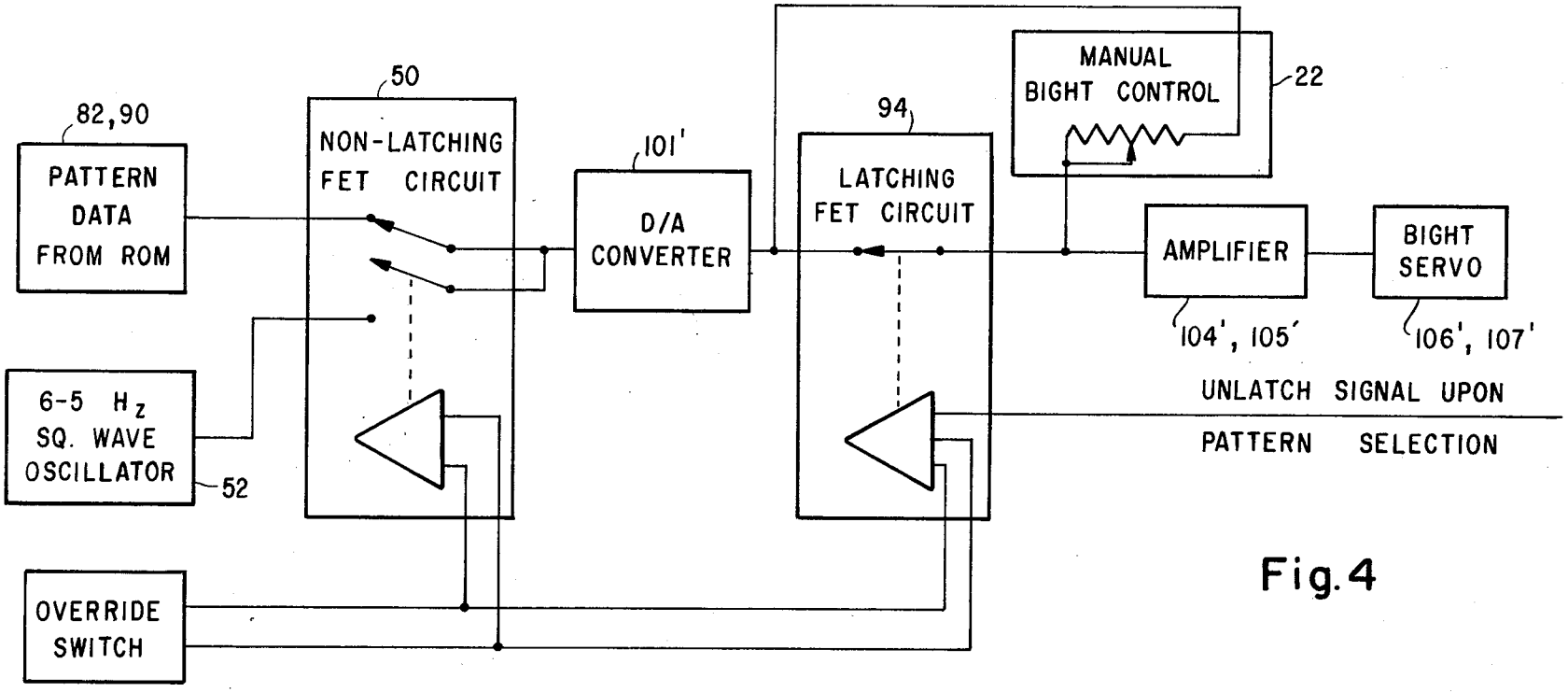
FIG. 4 is a block diagram showing an embodiment of this invention.

Referring to FIG. 1, there is shown a sewing machine having a bed 2, a standard 4, bracket arm 8, and a sewing head 10 with a reciprocating needle bar 12 and sewing needle 14 attached thereto, said needle bar adapted for lateral vibratory motion with respect to said bed 2 for the formation of geometric stitch patterns. A work engaging feed dog 18 is operationally supported within said bed 2 and projects upwardly into clearance apertures formed in a throat plate 20 which is removably attached to said bed 2. Said feed dog 18 is adapted for longitudinal vibratory motion with respect to said bed 2 and operates in conjunction with a presser foot 16 for the controlled feeding of the work piece in cooperation with said needle bar 12 for the formation of said ornamental stitch patterns. An operator actuatable bight control 22 and feed control 24 are conveniently positioned on the standard 4 for operator control of the amplitude of vibratory motion of the needle bar 12 and feed dog 18 respectively. Such controls are well known by those skilled in the art and therefore will not be described in detail here. Further, it may be desirable to automatically position the needle bar 12 to a predetermined height above the bed 2 of the sewing machine whenever the bight control 22 is adjusted by the operator. Similarly, the work feed dog 18 may be set to a predetermined position within the normal path of the feed dog during work feeding and work suspending movements whenever the feed control 24 is adjusted by the operator. Devices for performing such manipulations are well known by those skilled in the art. See, for example: U.S. Pat. No. 3,847,100, Nov. 12, 1974, Garron which discloses control means which, upon the selection of any pattern, a skip stitch mechanism will suspend needle reciprocation for one stitch forming cycle; and U.S. Pat. No. 4,142,474, Mar. 6, 1979, Bowles which discloses control means which, upon the selection of any pattern by the pattern selector means, causes the needle to initially go to a central position, the teachings of both of which are hereby incorporated herein by reference.

Referring to FIG. 2, there is shown a portion of the sewing needle 14 having lateral vibratory motion imparted thereto by the needle bar 12. Experimentation has shown that a vibratory motion having a frequency of between 6 to 15 hertz (cycles per second) will be within the range that is visually observable resulting in a visual image of a stationary needle at the two extreme excursions 14', 14'' of the needle 14. Although not necessary for the successful practice of this invention, best results are achieved if the vibratory motion is such that a dwell occurs at these two extreme excursions 14', 14", thus enhancing the image of the stationary needle at each extreme while lessening any image of a needle within the area 30 between the extreme excursions.

Referring to the block diagram of FIG. 4, preprocessed bight information obtained from the stitch pattern ROM is presented to a digital-to-analog converter which outputs a DC analog voltage representing the required needle position coordinates. With the FET switch 94 closed, the circuit is in the automatic mode whereby the analog voltage is presented to a servo-amplifier system and on to the bight servo system for effecting positioning of the needle. With the FET switch 94 open, the circuit is in the manual mode and the analog voltage is routed through a rheostat control 22 prior to presentation to the servo-amplifier system. The control 22 permits manual adjustment of the maximum bight width that may be sewn. The maximum bight width obtained thereby exactly equals the bight width stored in the ROM for the pattern selected. The operator actuatable override switch serves to latch the FET switch 94 open so that the circuit is in the manual mode. A more detailed description of this circuitry may be found in U.S. Pat. No. 4,016,821, Apr. 12, 1977, Minalga, the teachings of which are incorporated herein by reference. Another FET switch 50, when in its unactivated state, is arranged to pass bight data from the stitch pattern ROM to the digital-to-analog converter. Like the switch 94, the switch 50 is activated by the override switch, however, it remains activated only so long as the override switch is activated. When the override switch is deactivated, so is the switch 50. A 6–15 hertz square wave oscillator has its output connected to the open terminal of the switch 50 so that when the switch 50 is activated, bight data from the stitch pattern ROM will be ignored and the 6–15 hertz signal will be directed to the digital-to-analog converter. The override switch may be of the proximity capacitance type described in U.S. Pat. No. 4,055,129, Oct. 25, 1977, Hunts et al, the teachings of which are incorporated herein by reference. While the above disclosure describes one way in which the needle bar may be made to vibrate at a specific frequency, other similar arrangements will, upon reading this disclosure, become apparent to one skilled in the art.

Again referring to FIG. 2, a partial work piece 32 is shown having a desired specific ornamental stitch pattern 34 temporarily marked thereon. In operation, the needle bar is caused to vibrate in a transverse direction at 6 to 15 hertz while not reciprocating so as to prevent the needle 14 from penetrating the work piece 32. The work piece, or sample material or the like, having a portion of the desired pattern marked thereon is placed in close proximity to the vibrating needle 14 so that its actual amplitude of vibration may be visually compared to the pattern marked on the work piece. The amplitude of vibration is then adjusted by operation of the bight control 22 until it closely coincides with the pattern as marked on the work piece. The work piece may then be positioned as desired under the vibrating needle and the normal sewing operation commenced. An indicator 40 having a vibratory motion of equal frequency and amplitude to that of, and in phase with the needle 14, is shown in FIG. 3. With this arrangement, the work piece 32 having a pattern 34 marked thereon is placed in close proximity to the indicator 40 and the amplitude of vibration of the needle 14 is adjusted as described above.

It will be understood that a replica of the pattern to be sewn is not necessary to the successful use of this invention. The needle bar may be made to vibrate at an amplitude equal to the maximum width of the pattern to be sewn and the work piece positioned under the vibrating needle by visually sighting the extreme needle excursions 14', 14" in relation to characteristic features on the work piece having a desired spatial relationship to the pattern being sewn.

The significant, fundamental principles characteristic of this invention are: (1) the capability, upon selection of a particular stitch pattern, to cause the needle, or any other appropriate sewing instrumentality, to vibrate at a certain frequency and in such a way so that a visual image of the maximum width of the pattern selected is visably apparent to the operator; (2) while the image is being observed, needle reciprocation is suspended or the needle is otherwise prevented from penetrating the work; and (3) while the image is being observed, an operator actuatable control may be operated to adjust the amplitude of vibration of the image so that when normal sewing mode is resumed, the width of the pattern being sewn will exactly correspond to the width of the observed image.

While the preferred embodiment described above illustrates the principles of this invention with respect to a sewing needle partaking of vibratory motion as described, it is expressly understood that these principles may be applied to other stitch forming instrumentalities that partake of vibratory motion wherein the amplitude of this vibratory motion influences the appearance of the stitches being sewn. Such other applications of these principles are deemed to be within the scope and spirit of this disclosure. It is to be understood that the preferred embodiment described herein is for purposes of illustration only and not to be construed as a limitation of this invention.

I claim:

1. A sewing machine having stitch forming instrumentalities and drive means therefor, at least one of said stitch forming instrumentalities partaking of vibratory motion forming lockstitches, wherein the amplitude of said vibratory motion influences the appearance of said stitches; control means for regulating the amplitude of said vibratory motion of said at least one of said stitch forming instrumentalities; and vibratory means for effecting said vibratory motion so that said at least one of said stitch forming instrumentalities will provide a visual representation of the actual amplitude of said vibratory motion while the drive means is ineffective to operate at least one other of said stitch forming instrumentalities.

2. A sewing machine as set forth in claim 1 wherein said control means is selectively influenceable by a sewing machine operator; and wherein said vibratory means for effecting said vibratory motion is operable only during said selected operator influence of said control means.

3. A sewing machine having stitch forming instrumentalities including a thread carrying needle supported for endwise reciprocation and lateral vibratory movement, and a work feeding mechanism for imparting reciprocatory work feeding and work suspending movements thereto;

a. drive means effective for operating said stitch forming instrumentalities in the formation of lock stitches;

b. control means selectively influenceable by the operator for regulating the amplitude of said lateral vibratory movement of said needle;

c. vibratory means distinct from said drive means and effective during periods of said selective influence by the operator for imparting said lateral vibratory movement to said needle at said regulated amplitude, even in the absence of said drive means being effective for operating at least one of said stitch forming instrumentalities.

4. A sewing machine as set forth in claim 3 further including means for automatically positioning said needle in a predetermined fixed position of endwise reciprocation during periods of said selective influence by the operator.

5. A sewing machine having stitch forming instrumentalities at least one of which partaking of a first vibratory motion in one plane and a second vibratory motion in another plane for forming lockstitches, the first vibratory motion being independent of the second vibratory motion, wherein the amplitude of said first and second vibratory motions influence the appearance of said stitches: control means for independently regulating the amplitude of said first and second vibratory motions; and vibratory means for independently effecting said first and second vibratory motions so that said at least one of said stitch forming instrumentalities will provide a visual representation of the actual amplitude of one of said first and second vibratory motions while the other of said first and second vibratory motions is suspended.

6. In a sewing machine having a sewing instrumentality capable of partaking of vibratory motion for influencing stitch appearance and an operator actuatable control for adjusting the amplitude of said vibratory motion, a method for setting a desired amplitude of said vibratory motion comprising:

a. causing said sewing instrumentality to partake of vibratory motion at a frequency sufficient so that a visual indication representing the actual amplitude of said vibratory motion may be observed;

b. providing a replica of a desired amplitude for a stitch pattern to be sewn;

c. placing said replica in adjacent proximity to said sewing instrumentality;

d. adjusting said operator actuatable control while observing said actual amplitude of vibratory motion and visually comparing same with said replica of desired amplitude until the desired amplitude of said vibratory motion is attained.

7. In a sewing machine having a sewing instrumentality capable of partaking of vibratory motion for influencing stitch appearance and an operator actuatable control for adjusting the amplitude of said vibratory motion, a method for positioning the work piece with respect to a stitch forming needle comprising:

a. causing said sewing instrumentality to partake of vibratory motion at a frequency sufficient so that a visual indication representing the actual amplitude of said vibratory motion is observed;

b. providing a replica of a desired amplitude for a stitch pattern to be sewn;

c. placing said replica in adjacent proximity to said sewing instrumentality;

d. adjusting said operator actuatable control while observing said actual amplitude of vibratory motion and visually comparing same with said replica of desired amplitude until they are substantially equal in magnitude;

e. placing the work piece in adjacent proximity to said needle;

f. superimposing said visual indication upon the work piece; and, g. adjusting the position of the work piece so that said visual indication is in a desired relation to characteristic features on the work piece.

8. The method of claims 6 or 7 wherein said sufficient frequency of said vibratory motion is substantially within the range of 6 to 15 hertz.

9. The method of claims 6 or 7 wherein said replica of desired amplitude is a visualization in the mind of the operator and said placing of said replica is the mental projection of said visualization.

10. The method of claims 6 or 7 wherein said observing said actual amplitude is accomplished by viewing a limited area of said sewing instrumentality.

11. The method of claims 6 or 7 wherein said observing said actual amplitude is accomplished by providing an indicator having an oscillatory motion of substantially equal amplitude to said actual amplitude of said vibratory motion and viewing said indicator.

* * * * *